US007389760B2

(12) United States Patent
Fogolini

(10) Patent No.: US 7,389,760 B2
(45) Date of Patent: Jun. 24, 2008

(54) MODULAR ENGINE COVER

(75) Inventor: Jimmey Fogolini, Livonia, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 52 days.

(21) Appl. No.: 11/382,495

(22) Filed: May 10, 2006

(65) Prior Publication Data

US 2007/0261661 A1 Nov. 15, 2007

(51) Int. Cl.
*F02B 77/00* (2006.01)

(52) U.S. Cl. ..... 123/195 C; 123/195 R; 123/198 E

(58) Field of Classification Search ..... 123/195 R, 123/195 C, 195 S, 198 R, 198 E; D15/1, D15/5, 13

See application file for complete search history.

(56) References Cited

U.S. PATENT DOCUMENTS 2,529,616 A * 11/1950 Kraker ..... 123/90.38
5,040,628 A * 8/1991 Price ..... 180/69.21
5,365,901 A 11/1994 Kiczek
6,240,903 B1 6/2001 Kurozumi
6,491,014 B1 * 12/2002 Eickert ..... 123/195 C
6,701,884 B2 * 3/2004 Schneider et al. ..... 123/195 C
6,769,510 B2 * 8/2004 Ueno et al. ..... 181/204
6,784,560 B2 * 8/2004 Sugimoto et al. ..... 290/1 R
6,997,130 B1 * 2/2006 Fretwell ..... 114/211
2002/0112684 A1 8/2002 Jones et al.
2004/0025827 A1 * 2/2004 Davis ..... 123/198 E
2005/0217634 A1 10/2005 Nonogaki et al.
2006/0060404 A1 * 3/2006 Buell et al. ..... 180/219
2006/0070599 A1 * 4/2006 Nonogaki et al. ..... 123/195 C

* cited by examiner

*Primary Examiner*—Stephen K. Cronin
*Assistant Examiner*—Ka Chun Leung
(74) *Attorney, Agent, or Firm*—Allan J. Lippa; Bir Law, PLC; David S. Bir

(57) ABSTRACT

An engine cover for a vehicle includes a frame extending generally about the perimeter of the cover and adapted for mounting to an engine of the vehicle, and a skin extending across and secured to the frame. In one embodiment, the frame is made of a moulded plastic material and the skin is a stamped metal, such as aluminum. In another embodiment, the skin comprises multiple sections each secured to the frame so that one or more sections may be modified to alter the appearance of the cover and/or location of service items, such as an oil fill cap or dip stick for different applications while minimizing the number of components that need modification. A method for covering an engine according to the present invention includes securing at least one engine cover skin to an engine cover frame and securing the frame to an engine.

20 Claims, 6 Drawing Sheets

MODULAR ENGINE COVER

BACKGROUND OF THE INVENTION

1. Field of the Invention

The present invention relates to a cover for a vehicle engine.

2. Background Art

The engine compartment of a vehicle presents various challenges for vehicle engineers and designers in providing functionality, serviceability, and aesthetics in a relatively small space. Consideration must also be given to manufacturing and assembly costs in addition to weight, which ultimately impacts fuel economy, to deliver a competitive product. An engine cover may be used to enhance the overall appearance of the engine compartment and may also reduce engine noise transmission.

Various prior art engine covers provide a cast or molded cover with a solid, generally rectangular surface that extends across the engine cylinders, such as disclosed in US 2005/0217634 A1, for example. Modifications to this type of cover to change the appearance or to accommodate engines with different service item locations typically require significant tooling costs. The present inventor has also recognized that the thickness of the solid surface of a conventional engine cover required to provide a desired structural integrity may add unnecessary weight to the vehicle.

SUMMARY OF THE INVENTION

An engine cover for a vehicle includes a frame extending generally about the perimeter of the cover and adapted for mounting to an engine of the vehicle, and a skin extending across and secured to the frame. In one embodiment, the frame is made of a molded plastic material and the skin is a stamped metal, such as aluminum. In another embodiment, the skin comprises multiple sections each secured to the frame so that one or more sections may be modified to alter the appearance of the cover and/or location of service items, such as an oil fill cap or dip stick for different applications while minimizing the number of components and associated costs that need modification. One or more isolators may be secured to the frame and adapted for mounting on the engine to reduce or eliminate cover vibration and associated noise during operation of the engine.

A method for covering an engine according to the present invention includes securing at least one engine cover skin to an engine cover frame and securing the frame to an engine. The method may also include securing one or more isolators to the frame prior to securing the frame to the engine. In one embodiment, a common frame is used with different skins to provide engine covers with varying appearances and/or to accommodate applications with different service item locations.

The present invention provides a number of advantages. For example, the present invention reduces weight of the engine cover while providing a common bridge structure that may be used for multiple engine applications to reduce tooling and manufacturing costs. An engine cover with a modular structure according to the present invention allows use of multiple skins to change the overall appearance in addition to accommodating different location of service items, such as an oil fill hole or dip stick location, for example.

The above advantages and other advantages and features of the present invention will be readily apparent from the following detailed description of the preferred embodiments when taken in connection with the accompanying drawings.

DETAILED DESCRIPTION OF THE PREFERRED EMBODIMENT(S)

As those of ordinary skill in the art will understand, various features of the present invention as illustrated and described with reference to any one of the Figures may be combined with features illustrated in one or more other Figures to produce embodiments of the present invention that are not explicitly illustrated or described. The combinations of features illustrated provide representative embodiments for typical applications. However, various combinations and modifications of the features consistent with the teachings of the present invention may be desired for particular applications or implementations.

Figure 1:
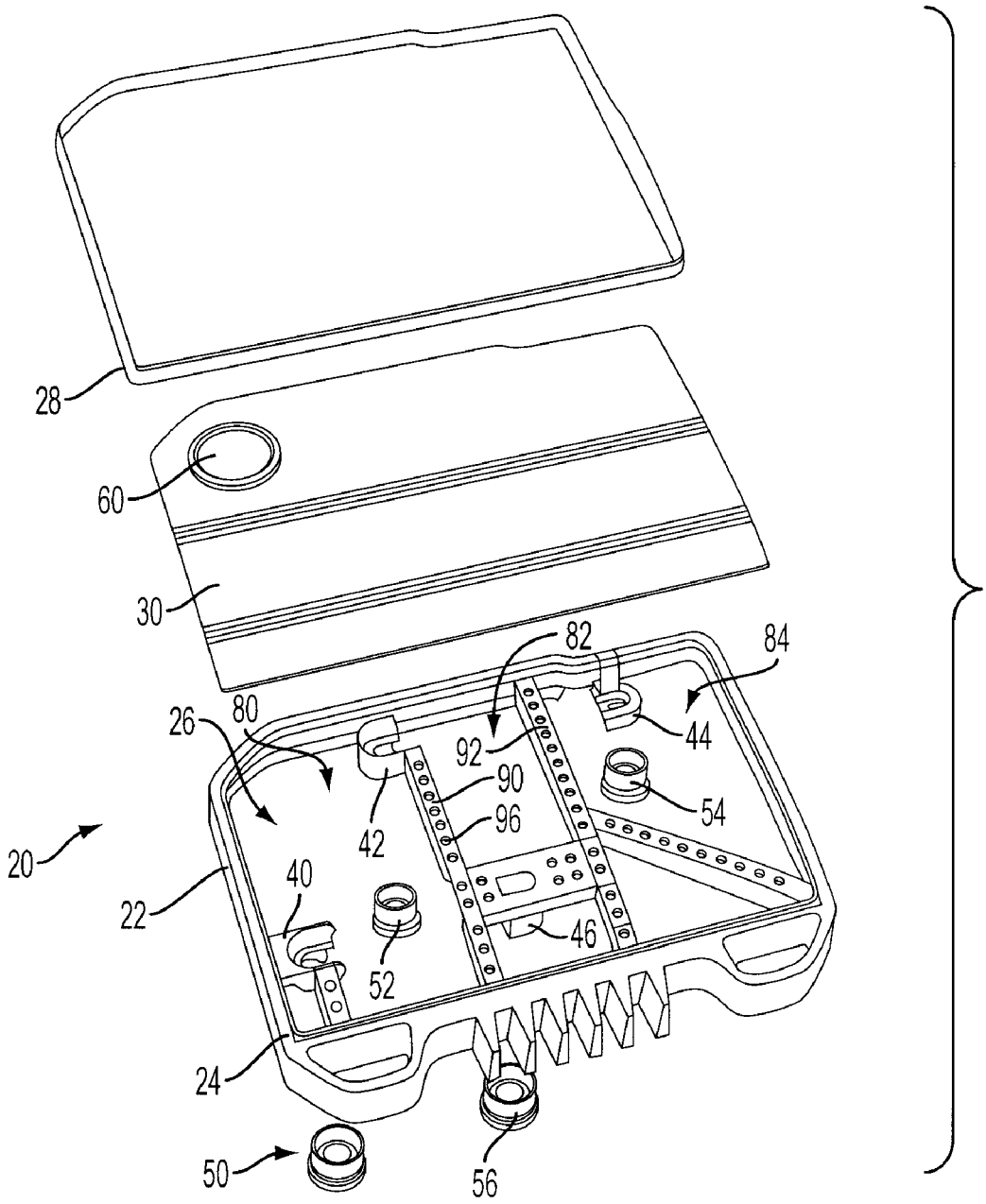
FIG. 1 is a perspective view of a modular engine cover assembly according to one embodiment of the present invention.

Referring now to FIG. 1, an engine cover 20 includes a frame 22 extending generally about the perimeter of cover 20. In the embodiment illustrated in FIG. 1, frame 22 includes a recess or groove 24 (best shown in FIG. 3) extending around a main opening 26 and adapted to receive a retainer 28 to secure cover plate 30 to frame 22. A plurality of receivers or mounting bosses 40, 42, 44, 46 are integrally formed in frame 22 and spaced about the perimeter. Each mounting boss or receiver is adapted to receive a corresponding rubber isolator or mounting buck 50, 52, 54, and 56, respectively. The isolators cooperate with corresponding mounting posts on the engine (not shown) to secure engine cover 20 to the engine. Isolators 50, 52, 54, and 56 operate to reduce or eliminate vibration and associated noise transmission through cover 22 during operation of the engine while securing cover 22 to the engine.

Figure 2:
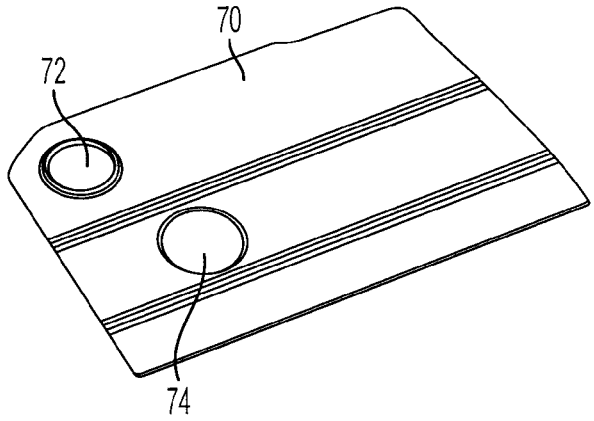
FIG. 2 illustrates an alternative cover plate or skin for a modular engine cover according to one embodiment of the present invention.

As illustrated in FIG. 1, frame 22 defines a main opening 26 that cooperates with a corresponding opening 60 in cover plate or skin 30 to provide access through cover 20 to one or more vehicle components located in the engine compartment, such as the engine, motor, and/or transmission, for servicing. For example, opening 60 may cooperate with opening 26 to provide access to an engine oil fill cap, oil dip stick, transmission oil dip stick, etc. Depending upon the particular application and implementation opening 60 may be eliminated, or the cover plate may include multiple holes or openings to provide access to underlying components. For example, as illustrated in FIG. 2, cover plate 70 includes openings 72 and 74 that cooperate with one or more openings in an associated frame (not shown) to provide access to corresponding engine/powertrain components that may extend through cover 20, or be accessed through openings 70, 72, for example. In the embodiment of FIG. 1, main opening 26 in frame 22 may be divided into a plurality of openings 80, 82, 84 by cross beams 90, 92 to accommodate alternative locations for engine service access. Cross beams 90, 92 may include an array of attachment apertures 96 to secure one or more cover plates 30 to a common frame 22 as described in greater detail below. In addition to providing flexibility in attaching alternative cover plates 30, attachment apertures 96 reduce the amount of material and associated weight required for frame 22. In this embodiment, cover plate 30 extends across frame 22 to cover all of openings other than the area of opening 80 corresponding to hole 60 in cover plate 30. This feature of the present invention allows a common frame 22 to be used for different engine covers 20 by replacing cover plate 30 with a plate having holes 60 corresponding to the engine service access locations for a particular engine, or to provide a different appearance for various engine/vehicle models. As such, the modular engine cover 20 according to the present invention can accommodate modifications in service access openings due to design changes and/or for use on different engines with reduced tooling and manufacturing costs.

According to one aspect of the present invention, modular engine cover 20 separates the structural support provided by frame 22 from the primarily aesthetic cover plate or skin 30 to reduce the weight of the cover. In one representative implementation, the overall weight reduction was estimated at 1.5 lbs (0.68 kg) based on reducing the material thickness of frame 22 and cover plate 30. In this implementation, frame 22 is integrally formed of a molded plastic material with cover plate 30 made of a stamped metal, such as aluminum. When one or more stamped metal cover plates are used, they may be reinforced with a poured plastic on the underside, if desired, to increase structural integrity for a particular application.

Figure 3:
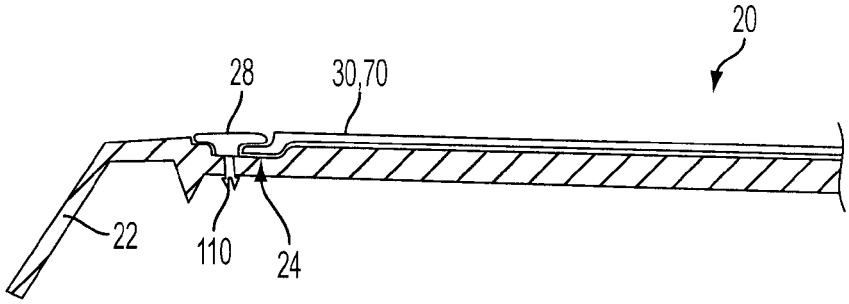
FIG. 3 is a cross-sectional view of an engine cover having a retainer for securing a skin to a frame according to one embodiment of the present invention.

Referring now to FIG. 3, a cross-section of an engine cover 20 is shown illustrating one method of attaching a cover plate or skin 30,70 to a structural support 22 according to the present invention. Structural support 22 includes a recess or groove 24 extending around the perimeter of the main opening (not shown). Recess or groove 24 may include round or elongated through holes adapted to receive and secure retainer 28. In the illustrated embodiment of FIG. 3, retainer 28 has a "T"-shaped cross-section with an integrally formed expandable post or pin 110 to secure retainer 28 and skin 30, 70 to structural support 22. Depending upon the particular application and implementation, groove or recess 24 may have a profile that secures retainer 28 without any through holes or associated pins/posts. In one embodiment of the present invention, assembly of engine cover 20 includes positioning the edges of cover plate 30, 70 into groove 24 and inserting retainer 28 into groove 24 to secure cover plate 30, 70 to frame 22. Those of ordinary skill in the art will recognize various alternative implementations to secure a cover plate 30, 70 to structural support 22 using a retainer 28 consistent with the teachings of the present invention.

Figure 4:
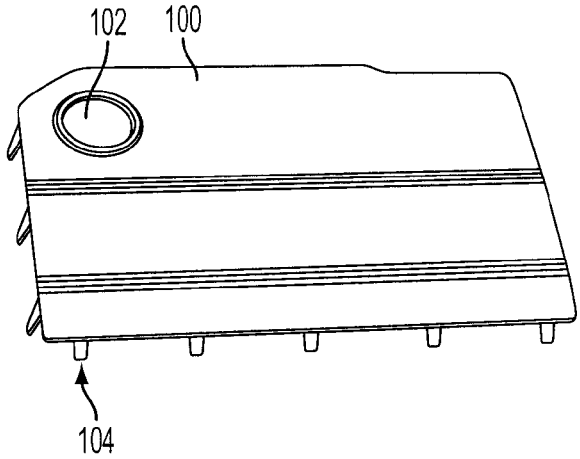
FIG. 4 illustrates a cover plate or skin with an alternative fastening method to secure the skin to the frame of an engine cover according to one embodiment of the present invention.
Figure 5:
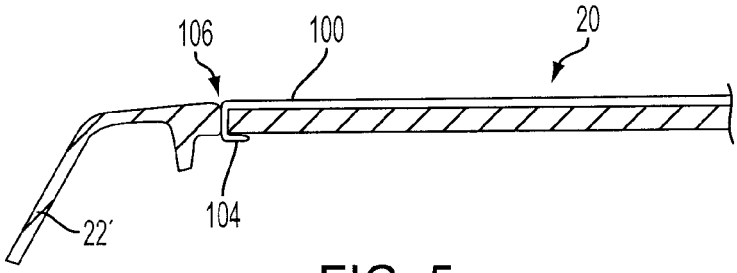
FIG. 5 is a cross-section of an engine cover illustrating the skin of FIG. 4 secured to a frame according to one embodiment of the present invention.

Another embodiment of a cover plate or skin 100 is illustrated in FIG. 4. In this embodiment, cover plate 100 includes an engine service access hole 102 and a plurality of attachment devices implemented by tabs 104. As shown in FIG. 4, tabs 104 are spaced around the perimeter of cover plate or insert 100. Tabs 104 are made of a material and thickness so that they may be deformed or bent to secure cover plate 100 to a corresponding frame or structural support as shown in FIG. 5. Frame 22' of FIG. 5 includes a plurality of through holes 106 adapted to receive tabs 104 of cover plate 100. Assembly of engine cover 20 includes aligning tabs 104 on cover plate 100 with the corresponding holes or attachment apertures 106 so tabs 104 extend through holes 106 and subsequently bending tabs 104 to secure cover plate 100 to frame 22'.

Figure 6:
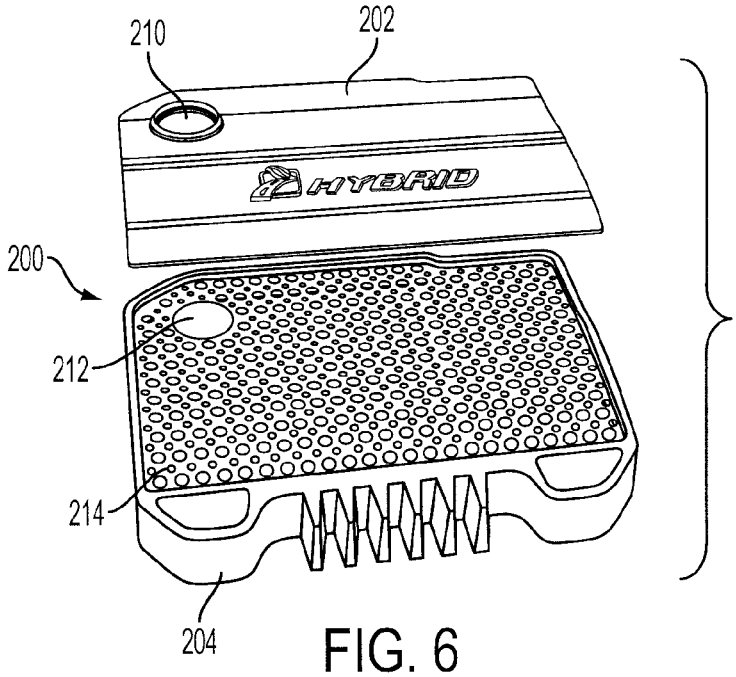
FIG. 6 is a perspective view of an alternative implementation of a modular engine cover including a configurable frame with an array or attachment apertures according to one embodiment of the present invention.

FIG. 6 illustrates another embodiment of an engine cover 200 according to the present invention. Engine cover 200 includes a skin 202 secured to a structural support member 204. Skin 202 includes an engine service access opening 210 that aligns with a corresponding opening 212 in the top surface of structural support member 204. Support member 204 also includes an array of attachment apertures 214 that may function to attach one or more cover plates or skins 202 to support member 204, if desired. As another alternative, a stamped metal skin 202 may be secured with a bonding adhesive, or may include a poured plastic reinforcement layer having pins or stakes that extend through attachment array 214 and are melted in a hot staking process to secure skin 202 to support 204. Similar to the previously described embodiment with an array of holes in the cross beams of the frame, an array of holes in the top surface also functions to reduce the amount of material required for molding and the associated weight of the assembly.

Figure 7:
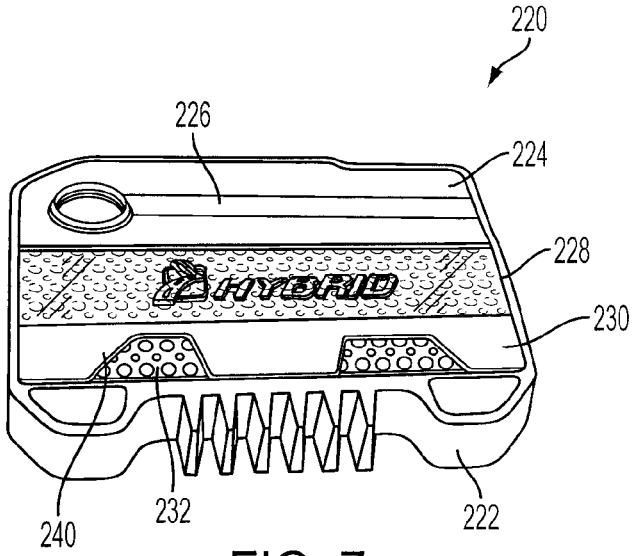
FIG. 7 illustrates an engine cover having a plurality of skins or cover plates including at least one translucent skin secured to a common reconfigurable frame according to one embodiment of the present invention.

In the embodiment of a modular engine cover 220 illustrated in FIG. 7, a structural support member 222 includes a plurality of skins or cover plates 224, 226, 228, and 230 secured thereto. Structural support 222 includes an array of attachment apertures 232. Skins 224, 226, 228, and 230 may be provided as a subassembly that is subsequently attached to the top surface of structural support 222, or may be individually attached depending on the particular application and implementation. As illustrated in the embodiment of FIG. 7, the present invention provides the ability to more easily change the appearance of engine cover 222 by using one or more alternative cover plates or skins. As shown in FIG. 7, engine cover 220 includes a stamped metal insert 226 in an opaque plastic plate 224. A translucent plate 228 partially obscures the underlying support structure 222 and/or engine components (not shown) when installed. Opaque plate 230 may include one or more cut-outs 240 to reveal the underlying support structure and/or engine/vehicle components when installed.

As previously described, the present invention contemplates various combinations of the features illustrated and described although all such combinations are not explicitly illustrated or described. For example, multiple skins or cover plates may be attached to the support structure or frame using any of a number of attachment methods. Similarly, multiple skins may be used with various frame designs although illustrated with respect to only the design of FIG. 7.

Figure 8:
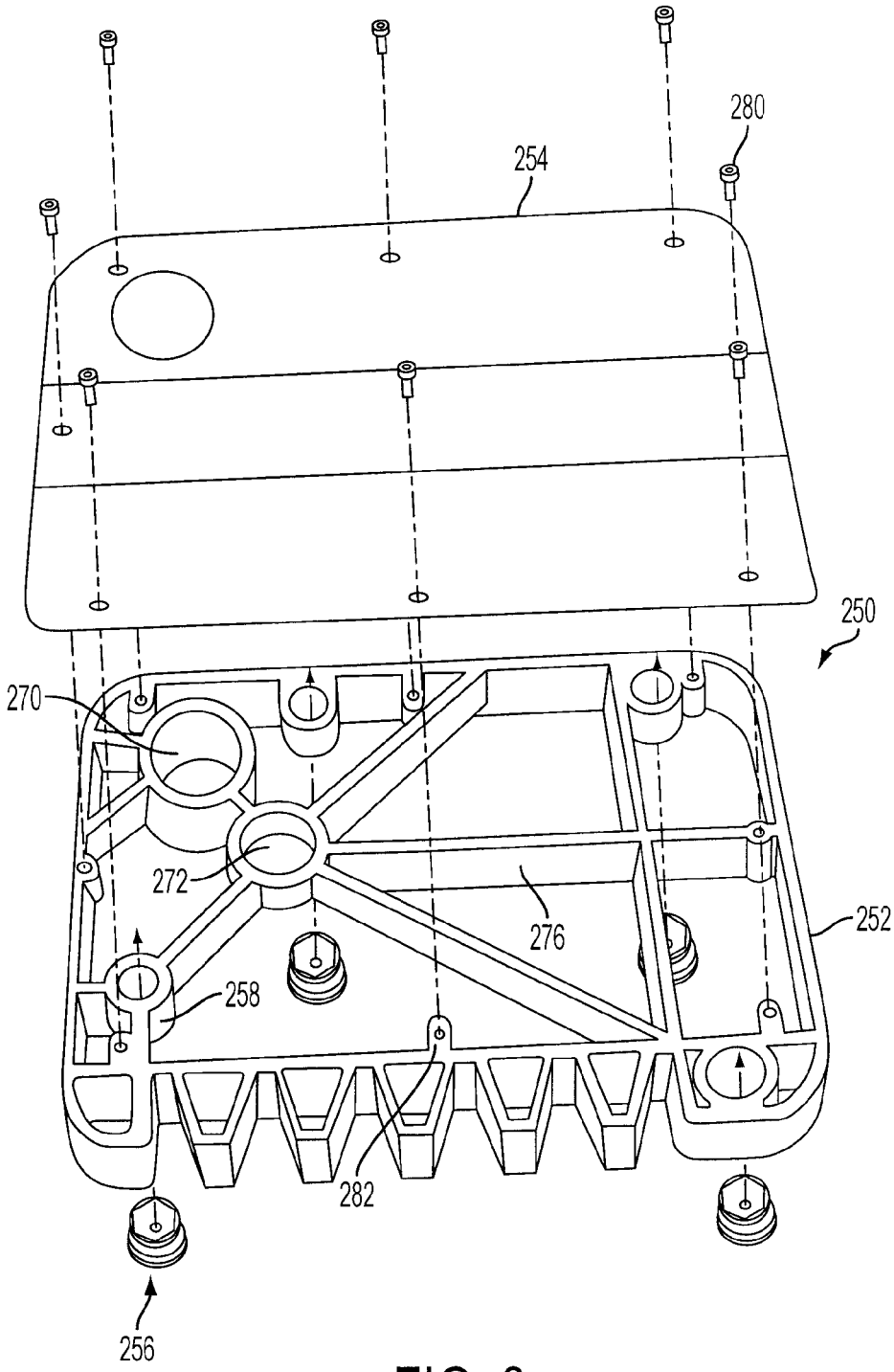
FIG. 8 illustrates another embodiment of a modular engine cover with a frame and cover plate secured to the frame according to the present invention.
Figure 10:
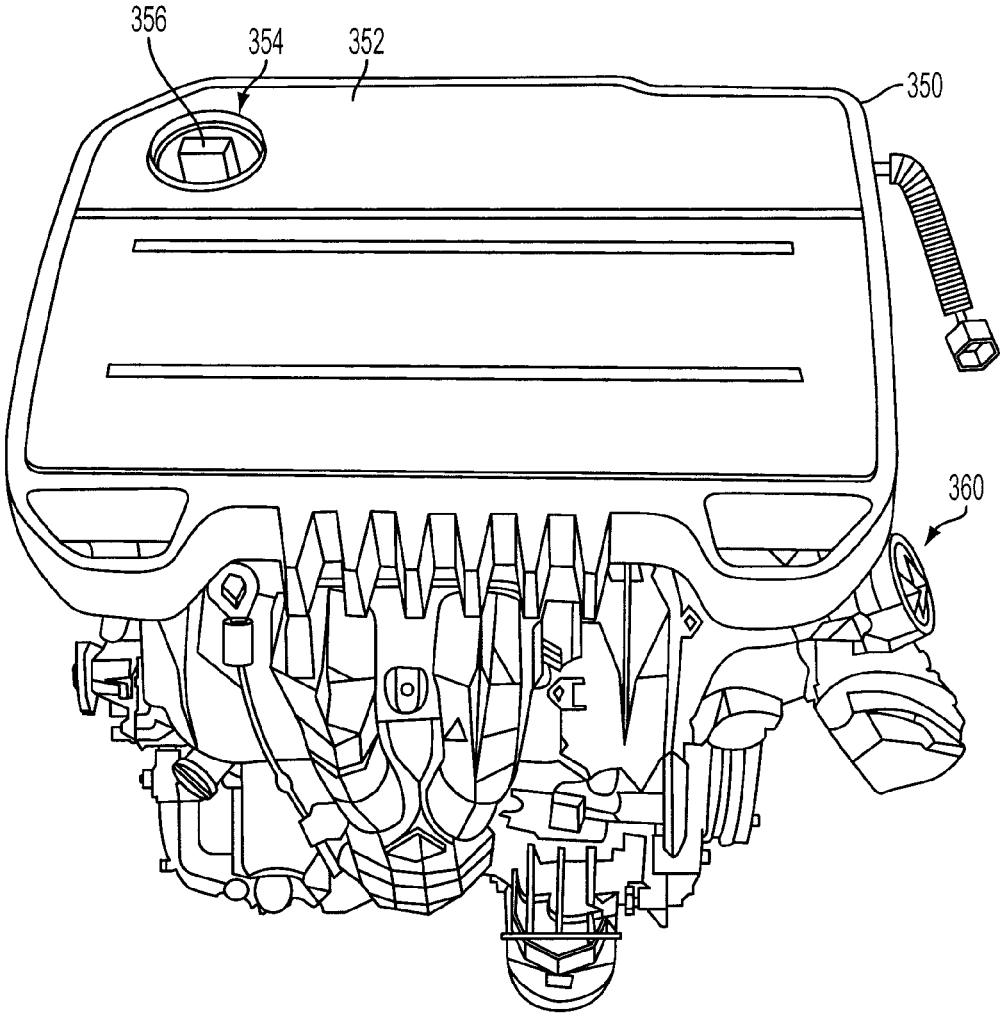
FIG. 10 is a perspective view of an engine cover according to the present invention installed on an engine.

Referring now to FIG. 8, another embodiment of a modular engine cover 250 according to the present invention is shown. Cover 250 includes a frame 252 and a cover plate 254. Mounting bucks or isolators 256 are retained by corresponding bosses 258 of frame 252 to secure frame 252 to the engine (FIG. 10). Frame 252 has a plurality of engine service access openings including generally circular openings 270, 272. Supports or beams 276 provide structural support for openings 270, 272 while also defining additional potential service access openings. In this embodiment, cover plate 254 extends across the primary opening of frame 252 to expose only one of the engine service access openings 270. An alternative cover plate (not shown) may then be used to expose the other engine service access opening 272 so that a common frame 252 can be used for engines having different locations for the access openings. As shown in FIG. 8, cover plate 254 may be secured to frame 252 using conventional fasteners 280 that engage corresponding bosses 282 on frame 252. Of course, other attachment methods may also be used in this embodiment as with all of the embodiments of the invention.

Figure 9:
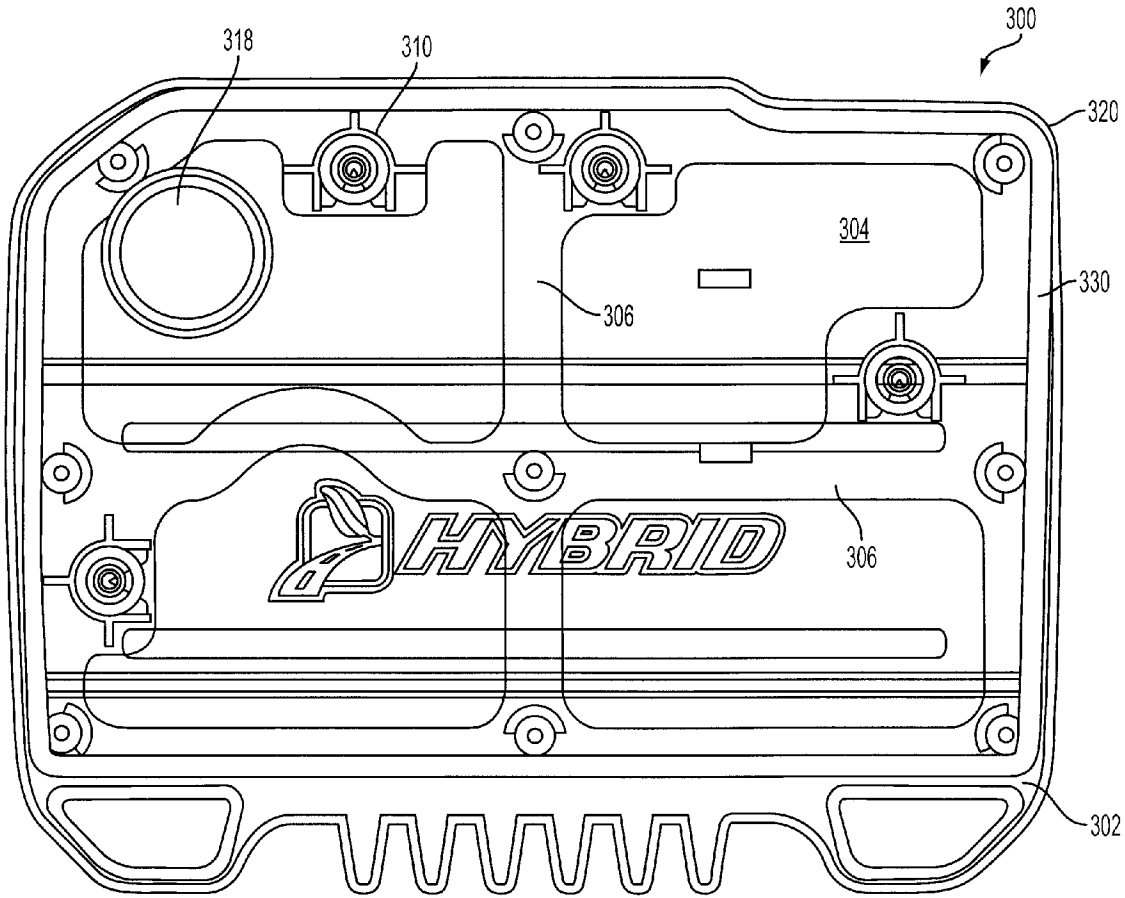
FIG. 9 illustrates an engine cover having a frame with at least two intersecting cross supports and a translucent skin secured to the frame according to one embodiment of the present invention.

FIG. 9 illustrates another embodiment of a modular engine cover 300 according to the present invention. Engine cover 300 includes a frame 302 and a translucent skin 304. Frame 302 includes intersecting cross beams 306 to provide structural support for engine cover 300. Receivers or bosses 310 include corresponding rubber isolators to secure cover 300 to corresponding mounting posts on an engine (FIG. 10). Cover plate 304 may include a plurality of alignment pins 320 to align cover 304 with frame 302 during assembly. Depending on the particular application and implementation, alignment pins or posts 320 may also be used to secure cover 304 to frame 302.

FIG. 10 illustrates a representative application for a modular engine cover 350 installed on an engine 360, which is a hybrid fuel engine in this example. Engine cover 350 includes a cover plate 352 having an engine service access opening 354 that allows access to an engine oil dipstick 356. Depending upon the particular purpose of the access opening, an engine/vehicle component may protrude through the top of the opening, remain within the opening, or be located beneath the opening.

As such, a modular engine cover according to the present invention separates the structural support member or frame from the primarily aesthetic cover plate or skin to reduce weight of the engine cover while providing a common bridge structure that may be used for multiple engine applications to reduce tooling and manufacturing costs. An engine cover with a modular structure according to the present invention allows use of multiple skins to change the overall appearance in addition to accommodating different locations for engine service access openings, such as an oil fill hole or dip stick location, for example.

While the best mode for carrying out the invention has been described in detail, those familiar with the art to which this invention relates will recognize various alternative designs and embodiments for practicing the invention as defined by the following claims.

What is claimed is:

1. An engine cover comprising:

a frame extending generally about the perimeter of the cover and adapted for mounting to an engine of a vehicle, the frame adapted to receive at least one mounting isolator;

at least one mounting isolator cooperating with the frame and a corresponding mounting post on the engine, the mounting isolator reducing vibration of the engine cover during operation of the engine; and at least one cover plate secured to the frame to at least partially conceal a top portion of the engine when the engine cover is installed.

2. The engine cover of claim 1 wherein the frame comprises a top surface having an array of attachment apertures cooperating with corresponding tabs on the at least one cover plate to secure the at least one cover plate to the frame.

3. The engine cover of claim 1 wherein the at least one cover plate comprises a plurality of cover plates secured to a top surface of the frame.

4. The engine cover of claim 1 wherein the frame comprises at least two cross-beams extending across the perimeter of the frame.

5. The engine cover of claim 1 wherein the at least one cover plate comprises a translucent cover plate.

6. The engine cover of claim 1 wherein the frame includes a plurality of receivers spaced from one another about the frame perimeter and wherein the at least one mounting isolator comprises:

a mounting isolator positioned in each of the receivers for cooperating with corresponding mounting posts on the engine, the mounting isolators reducing vibration of the engine cover during operation of the engine while securing the frame to the engine.

7. The engine cover of claim 1 wherein the frame includes a groove extending about the perimeter, the engine cover further comprising:

a retainer having a portion insertable into the groove in the frame and a portion cooperating with the edge portion of the cover plate to secure the cover plate to the frame.

8. The engine cover of claim 1 wherein the cover plate comprises a plurality of tabs for extending through corresponding apertures in the frame to secure the cover plate to the frame.

9. The engine cover of claim 1 wherein the frame includes a plurality of openings therewithin to accommodate alternative locations for a selected engine service access and wherein the at least one cover plate covers all but one of the openings.

10. The engine cover of claim 1 wherein the frame comprises molded plastic and the at least one cover plate comprises a stamped metal plate.

11. A modular cover for a vehicle engine, the cover comprising:

a structural support having a plurality of mounting bosses for securing the structural support to an engine and a plurality of openings to accommodate engines with differing service access locations; and at least one skin secured to and substantially covering the structural support to at least partially conceal a top portion of the engine, the at least one skin covering all but one of the openings of the structural support to provide service access to the engine.

12. The cover of claim 11 further comprising a plurality of rubber isolators each being secured to one of the mounting bosses of the structural support to reduce vibration of the cover during operation of the engine.

13. The cover of claim 11 wherein the structural support comprises:

a plurality of integrally formed support arms extending from a perimeter of the support to define at least two generally circular openings to accommodate engine oil servicing.

14. The cover of claim 11 wherein the at least one skin comprises a plurality of skins secured to the structural support, with one of the plurality of skins having an aperture corresponding to one of the openings in the structural support.

15. A method for covering an engine in a vehicle, the method comprising:

securing at least one cover plate having at least one opening to a cover frame having a plurality of openings to accommodate engines having different engine service access locations to substantially cover the frame while exposing at least one of the plurality of openings; and securing the cover frame to the engine.

16. The method of claim 15 wherein the step of securing at least one cover plate comprises securing a plurality of cover plates to the cover frame.

17. The method of claim 15 wherein the step of securing at least one cover plate comprises securing a cover plate to the cover frame to cover at least one of the openings in the frame.

18. The method of claim 15 wherein the step of securing at least one cover plate comprises hot staking the cover plate to the cover frame.

19. The method of claim 15 wherein the step of securing at least one cover plate comprises:

aligning tabs on the cover plate with corresponding attachment apertures of the frame; and bending the tabs to secure the cover plate to the frame.

20. A method for covering an engine in a vehicle, the method comprising:

securing at least one cover plate to a cover frame having a groove extending generally about a frame perimeter by:

positioning edges of the cover plate in the groove of the frame perimeter; and inserting a retainer in the groove to secure the cover plate to the frame.

* * * * *